US006033067A

United States Patent [19]

Kakizaki et al.

[11] Patent Number: 6,033,067

[45] **Date of Patent: *Mar. 7, 2000**

[54] FEED SHEET FOLD REMOVING STRUCTURE AND METHOD USED IN INK JET RECORDING APPARATUS

[75] Inventors: Masaaki Kakizaki, Kawasaki; Yoji Ara, Yokohama; Tsutomu Shimada; Jun Katayanagi, both of Musashino; Takeji Niikura, Kawasaki; Shoichi Kan; Nozomu Nishiberi, both of Yokohama; Yasushi Koike, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,572

[22] Filed: Oct. 7, 1997

Related U.S. Application Data

[63] Continuation of application No. 08/490,086, Jun. 13, 1995, abandoned.

[30] Foreign Application Priority Data

Jun. 16, 1994 [JP] Japan ..... 6-159595

[51] Int. Cl.[7] ..... B41J 2/01

[52] U.S. Cl. ..... 347/104; 162/197; 162/270; 162/271; 271/161; 271/188; 400/613.3

[58] Field of Search ..... 347/8, 104; 162/197, 162/270, 271; 271/198, 161, 188, 209; 355/309, 322; 399/406; 400/613.2, 613.3

[56] References Cited

U.S. PATENT DOCUMENTS

| | | | |
|---|---|---|---|
| 1,654,946 | 1/1928 | Sinks | 162/271 |
| 2,973,957 | 3/1961 | Busch | 226/196.1 |
| 4,326,915 | 4/1982 | Mutschler, Jr. | 162/271 |
| 4,651,173 | 3/1987 | Ozawa et al. | 347/104 X |
| 4,674,899 | 6/1987 | Kimura | 400/613.2 |
| 4,892,994 | 1/1990 | Tsuchiya et al. | 162/271 |
| 5,009,749 | 4/1991 | Cederholm et al. | 162/270 |
| 5,059,049 | 10/1991 | Rosenthal | 400/605 |
| 5,183,454 | 2/1993 | Kurosawa et al. | 162/271 |
| 5,539,511 | 7/1996 | Wenthe, Jr. et al. | 162/270 |

FOREIGN PATENT DOCUMENTS

| | | | |
|---|---|---|---|
| 61-152474 | 7/1986 | Japan | 400/613.3 |
| 62-11663 | 1/1987 | Japan | 400/613.2 |
| 63-102965 | 5/1988 | Japan | 400/613.3 |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording apparatus is capable of preventing both contamination on a recording surface due to a contact of a recording medium on an ink discharging surface even when recording on the recording medium with a concave/convex portion and an ill-discharged state of an ink. The recording apparatus has a feeding unit for feeding a recording medium and a recording head as a recording unit for recording an image on the recording medium fed by the feeding unit. A first guide member (shaft) and a second guide member that serve as a correcting mechanism are provided upstream in a feeding direction from the recording head, for correcting the concave/convex portion of the recording medium.

5 Claims, 9 Drawing Sheets

FEED SHEET FOLD REMOVING STRUCTURE AND METHOD USED IN INK JET RECORDING APPARATUS

This application is a continuation of application Ser. No. 08/490,086 filed Jun. 13, 1995, now abandoned.

BACKGROUND OF THE INVENTION

1. Field of the Invention

The present invention relates generally to a recording apparatus for performing a record on, e.g., a consecutive sheet and, more particularly, to an ink jet type consecutive sheet recording apparatus for effecting a print by discharging out an ink.

2. Related Background Art

A wire dot type recording apparatus has hitherto been dominant among recording apparatuses for performing a record on a consecutive sheet. In recent years, however, an ink jet type consecutive sheet recording apparatus downsized but producing less recording noise has been also developed.

Further, the recording apparatus for personal use is requested to be of high recording quality. This recording quality is determined depending on factors such as an image density, an unevenness in density and a sharpness of image. In an ink jet recording apparatus, however, the image sharpness tends to become a subject of discussion. The following is a reason for this.

According to an ink jet recording system, the recording head is formed with a multiplicity of ink discharging nozzles in a direction orthogonal to the feeding direction of the recording medium, thereby discharging the inks at right angle to the surface of the recording medium. However, there is caused no problem if the inks are discharged in the same direction out of all the nozzles. As a matter of fact, there are deviations in terms of directions of discharging the inks out of the respective nozzles.

For example, as illustrated in FIG. 7, the inks should be discharged originally in a direction indicated by an arrowed dotted-line. In fact, however, there are some nozzles from which the inks are discharged in a direction indicated by an arrowed solid-line. In this case, an actual ink reaching point Q deviates by a distance $L_1$ from an original ink reaching point P, wherein $D_1$ is the interval between an ink discharging surface 58 of a recording head 57 and a recording medium 53.

Because of this deviation, the image sharpness and the recording quality deteriorate. The above deviation increases (distance $L_2$) in proportion to an increase in the interval (e.g., interval $D_2$) between the ink discharging surface 58 and the recording medium 53.

Further, the above problem may be derived from a difference between ink discharging speeds in addition to the deviation between the directions in which the inks are discharged out of the nozzles as the case may be. For instance, the ink droplets discharged out of the nozzles are classified from a larger size into a main droplet, a satellite and a microdot, but discharging speeds of these ink droplets are different.

Therefore, FIG. 8 illustrates the discharging directions in a case where the discharging speeds are $V_1$ and $V_2$ ($V_1<V_2$), and the discharging direction in the case of the discharging speed $V_1$ goes as indicated by an arrowed solid line, while the discharging direction in the case of the discharging speed $V_2$ goes as indicated by an arrowed broken line as a result of being synthesized with a moving speed component $V_H$ of the recording head 57. Thus, the respective discharging directions are different, and, hence, the image sharpness is poor. Then, the above deviation increases in proportion to a magnitude of the interval between the ink discharging surface 58 and the recording medium 53.

Accordingly, it is required that the interval between the ink discharging surface and the recording medium be as small as possible in order to enhance the recording quality in the ink jet recording apparatus.

As illustrated in FIG. 9, however, when the recording medium 53 is a consecutive sheet 53' in which sheet elements are folded alternately sheet by sheet along each score line, the sheet is guided by a tractor 51 of a recording apparatus 50 to a sheet feed roller 52, thus effecting a record. Herein, FIG. 9 is a sectional view showing a case where recording is performed on the consecutive sheet 53' by the conventional ink jet recording apparatus (push type).

In this instance, the consecutive sheet 53' was folded and resultantly formed concave/convex portions shown by numerals 54, 55. Especially, the portion 54 passes through the sheet feed roller 52 and is guided by a platen 56. Then, when recorded by the recording head 57, the portion 54 turns out a convex portion (herein referred to as a convex portion 54) protruding on the side of an ink discharging surface 58 of the recording head 57. In this state, when trying to reduce an interval between the ink discharging surface 58 and the consecutive sheet 53', the consecutive sheet 53' contacts the ink discharging surface 58, resulting in such problems that a recording surface of the consecutive sheet 53' is contaminated, and an ill-discharged state of the ink is produced because paper powders are adhered to an ink discharging port. Further, the same problems are also caused if the interval between the recording surface and the ink discharging surface is small with respect to the portion 55 (herein called a concave portion 55) in which the sheet is concaved on the side of the ink discharging surface 58.

SUMMARY OF THE INVENTION

It is a primary object of the present invention, which was devised to obviate the problems inherent in the above prior art, to provide a recording apparatus capable of preventing both contaminations on a recording surface due to a contact of a recording medium with an ink discharging surface even when recorded on a recording medium having a concave/convex portion and an ill-discharged state of an ink.

It is another object of the present invention to provide a recording apparatus comprising a feeding unit for feeding a recording medium and a recording unit for recording an image on the recording medium fed by the feeding unit. The recording apparatus further comprises a correcting unit, provided in a feeding direction upstream the recording unit, for correcting a concave/convex portion of the recording medium.

It is still another object of the present invention to provide a recording apparatus in which the correcting unit for correcting the concave/convex portion of the recording medium is provided in the feeding direction upstream the recording unit, with the result that a configuration of the recording medium approximates a plane.

It is yet another object of the present invention to provide a recording apparatus including a first guide member capable of bending the sheet toward either one of front and rear surfaces of the recording medium on the basis of the widthwise direction of the recording medium and a second guide member capable of bending the sheet to the other surface. The concave/convex portions on both of the front and rear surfaces of the recording medium are thereby corrected.

It is a further object of the present invention to provide a recording apparatus in which a bending force acts entirely in the widthwise direction of the recording medium by providing the guide members entirely in the widthwise direction of the recording medium, a tractor for regulating both edges of the recording medium is provided upstream in the feeding direction, and the tractor and the guide member are formed into one united body with the result that the number of parts is reduced.

DETAILED DESCRIPTION OF THE EMBODIMENTS

The present invention will hereinafter be discussed by way of illustrative embodiments.

(First embodiment)

Figure 1:
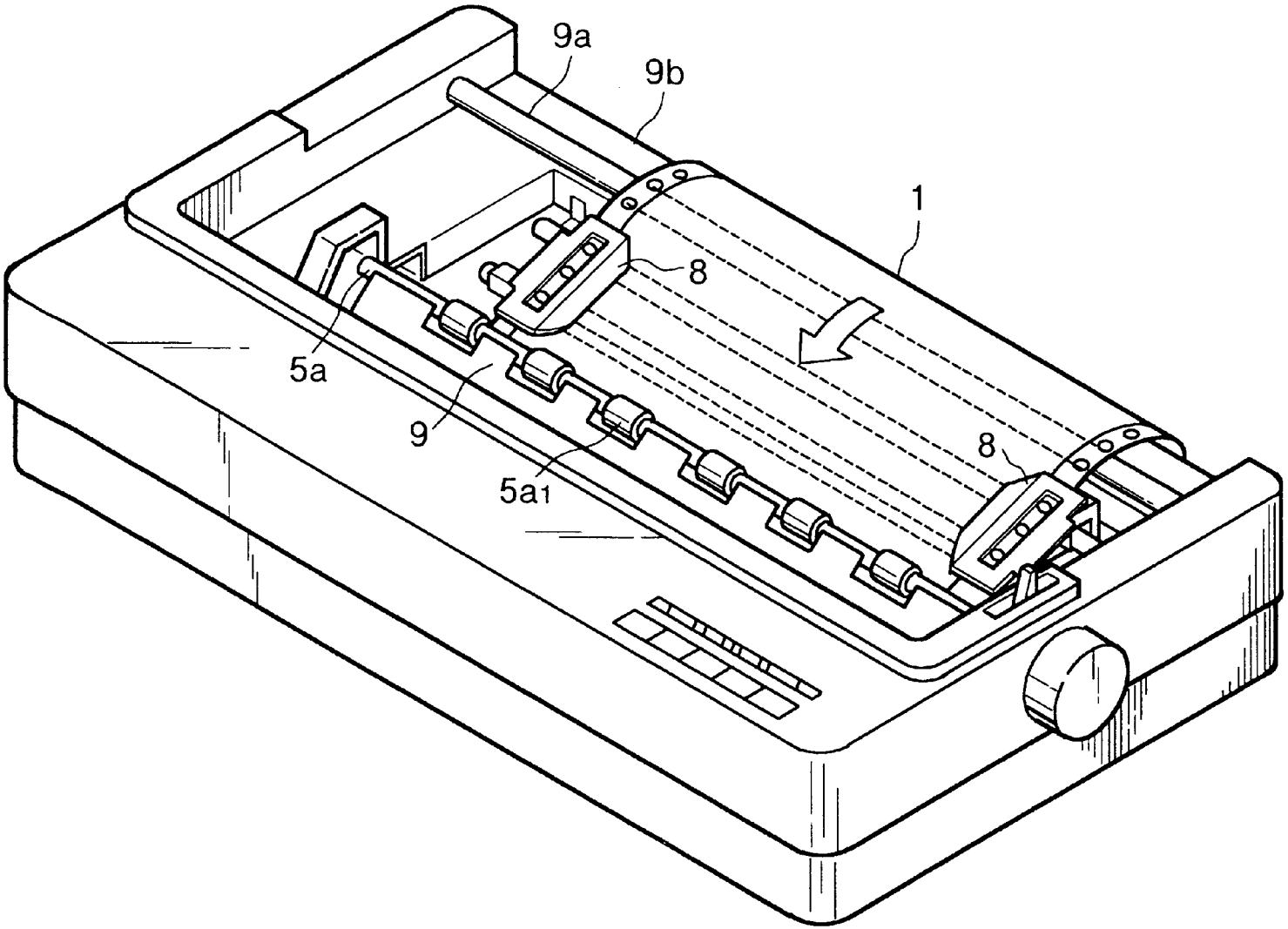
FIG. 1 is a perspective view illustrating an ink jet recording apparatus in an embodiment of the present invention.
Figure 2:
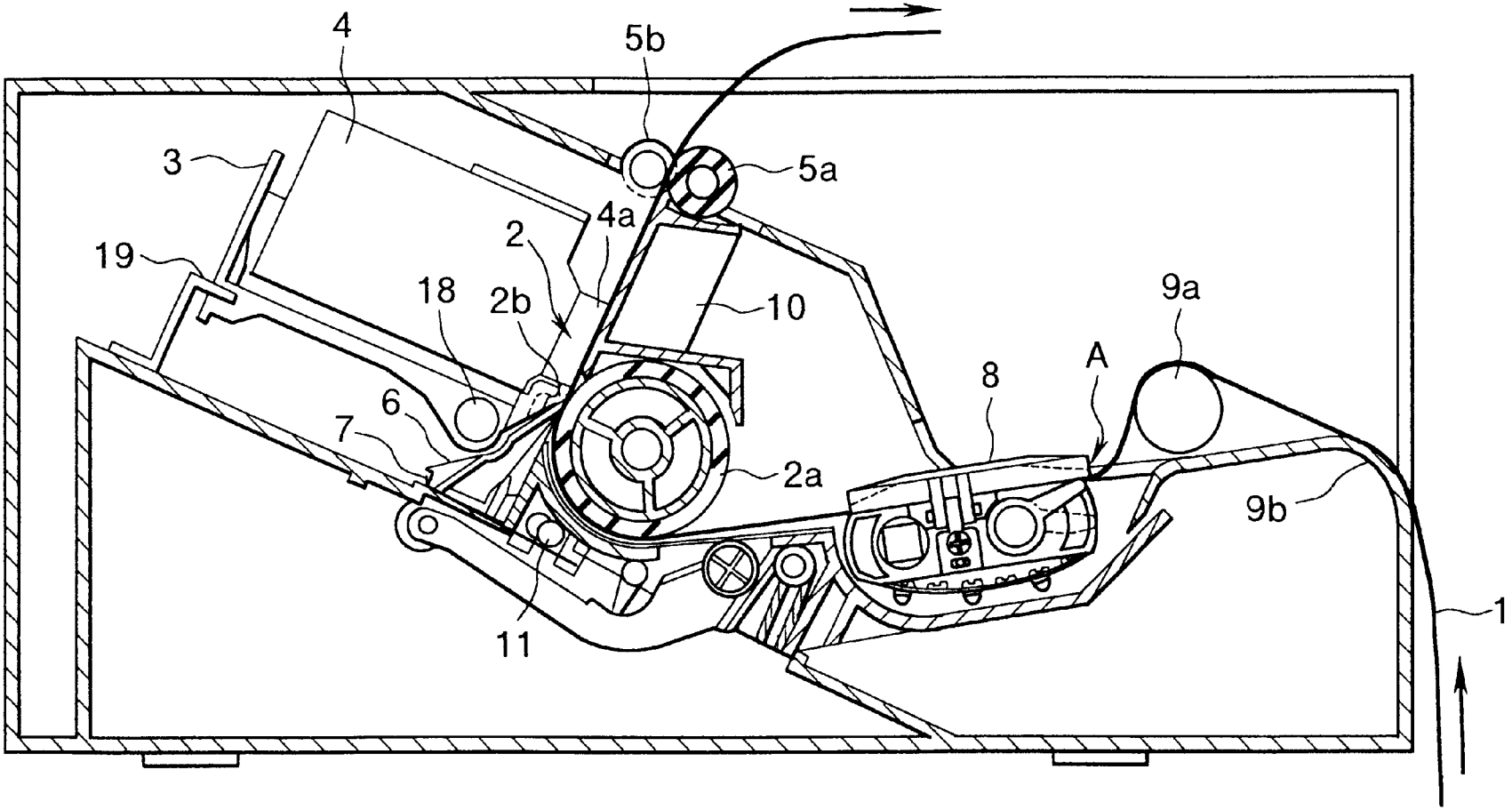
FIG. 2 is a sectional view illustrating the ink jet recording apparatus in the embodiment of the present invention.

An ink jet recording apparatus in accordance with a first embodiment of the present invention will be explained with reference to FIGS. 1 and 2. FIG. 1 is a perspective view illustrating the ink jet recording apparatus. FIG. 2 is a sectional view of the ink jet recording apparatus in FIG. 1. Then, FIGS. 3A to 3D are views showing how a concave/convex portion of a score line is reduced.

To start with, the whole construction of the apparatus will be explained. In this apparatus, a feeding unit 2 feeds a recording medium (paper, cloth, OHP sheet, etc.) 1. A recording head 4 serving as a recording unit detachably attached to a carriage 3 is reciprocated with respect to the recording medium 1, and, at the same time, an ink is discharged out corresponding to an image signal, thus effecting a record. Then, the recording medium 1 on which the record has been done is delivered to a predetermined delivering area by use of a delivering unit 5.

Configurations of the respective units described above will be explained in sequence.

(Feeding Unit)

The feeding unit 2 is a pair of rollers of a feed roller 2*a* and a pinch roller 2*b* and thereby feeds the recording medium 1 to a recording position.

In this apparatus, as illustrated in FIG. 2, a consecutive sheet 1' which is a kind of the recording medium 1 passes along the upper parts of a second guide member 9*b* serving as part of casing and a shaft 9*a* serving as a first guide member before being introduced into tractors 8 for feeding the sheet 1' having supporting holes formed in edge portions of the sheet 1' on both sides at equal intervals.

Figure 3A:
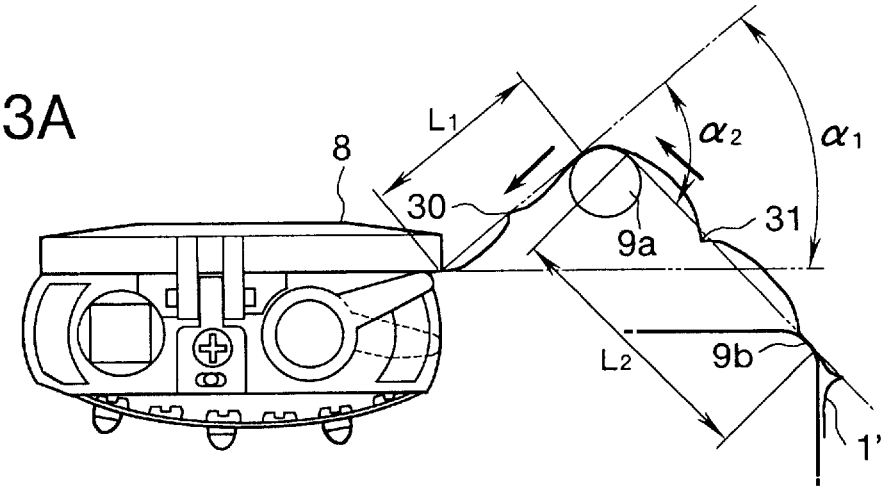
FIGS. 3A to 3D are explanatory views showing how a concave/convex portion of a score line area is leveled off.
Figure 3B:
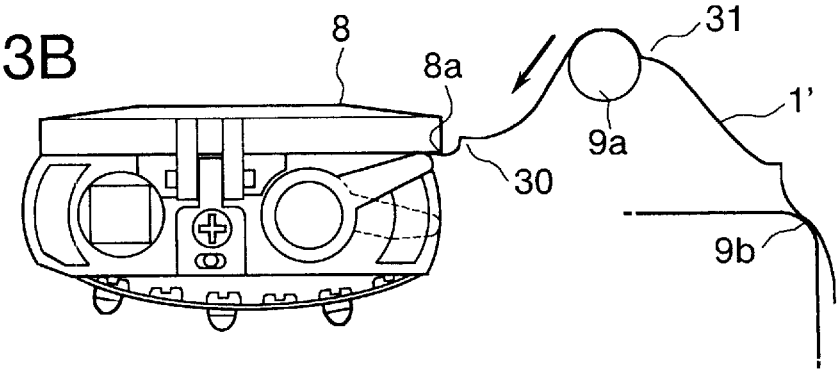
Figure 3C:
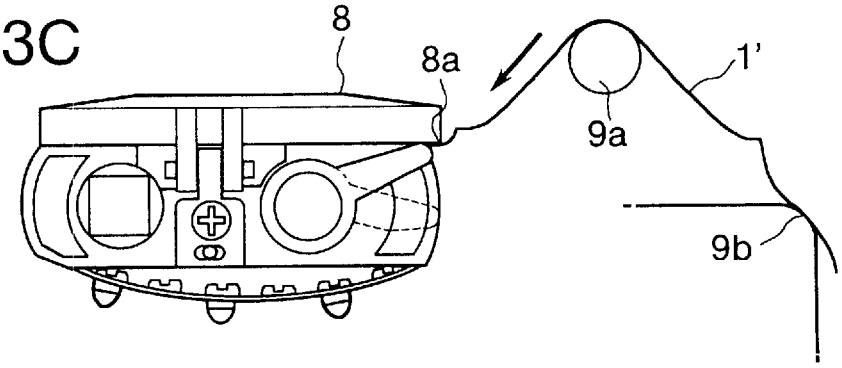

At this time, there is produced action to bend the consecutive sheet 1' reversely to the previous side at the shaft 9*a* in combination with a portion A from which the consecutive sheet 1' enters the tractors 8, whereby the concave/convex portion of the score line area is substantially leveled off. FIGS. 3A to 3C illustrate how this reversal bending of the score line area changes as the consecutive sheet 1' is fed.

In FIGS. 3A to 3C, a distance $L_1$ between the tractor 8 and the shaft 9*a* as the first guide member is 21 mm, an angle $\alpha_1$ formed by sheet surface is 32°, a distance $L_2$ between the shaft 9*a* as the first guide member and the second guide member 9*b* is 18.5 mm, and an angle $\alpha_2$ formed by the sheet surface is 83.5°.

First, the reversal bending of the concave portion of the score line area will be explained. A concave portion 30 is gradually leveled off from a relationship between $L_1$ and $\alpha_1$ as the concave portion 30 of the score line area comes closer to the tractor 8 from the shaft 9*a*. As illustrated in FIG. 3C, when the concave portion 30 reaches an edge portion 8*a* of the tractor 8, the sheet is bent reversely to the previous side. The concave portion 30 becomes substantially planar.

Similarly, a convex portion 31 of the score line area is gradually leveled off from a relationship between $L_2$ and $\alpha_2$ as the convex portion 31 becomes more closer to the shaft 9*a* from the second guide member 9*b*. As shown in FIG. 3C, when the convex portion 31 reaches the shaft 9*a*, the sheet is bent on the concave side reversely to the previous side, with the result that the convex portion 31 is substantially leveled off.

Figure 3D:
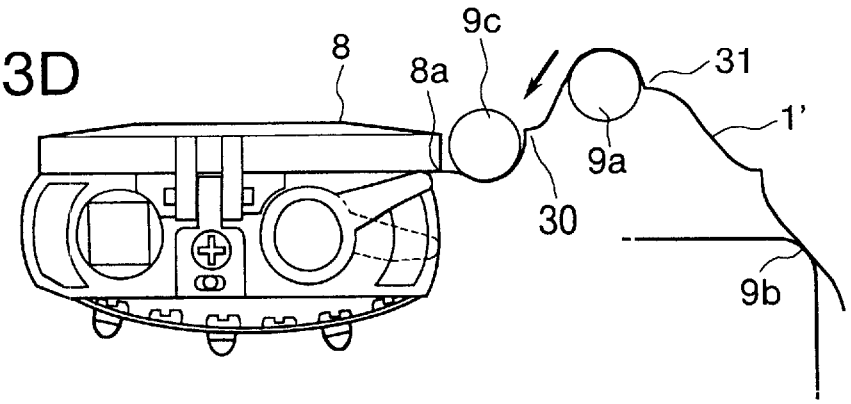

At this time, as illustrated in FIG. 3D, in order, that the concave portion 30 is reversely convexed, the shaft 9*c* can be also used instead of employing the edge portions 8*a* of the tractors 8. In this case, the shaft 9*c* can be disposed entirely in the sheet-widthwise direction in the same way as the shaft 9*a*. For this reason, there can be obtained a greater effect especially in the consecutive sheet 1' having a large sheet width than by providing the tractors 8 working as the guide members only at both edges of the consecutive sheet 1' as in the edge portions 8*a* of the tractors 8.

The consecutive sheet 1' thus leveled-off is nipped by the pinch roller 2*b*. A feeding force is given by rotationally driving the feed roller 2*a*, thus feeding the consecutive sheet 1'. The feed roller 2*a* is driven by an unillustrated driving source.

Herein, the above pinch roller 2*b* is rotatably provided at a front edge of a pinch roller guide 6 so provided as to be rotatable about a shaft extending in a direction parallel to a shaft of the feed roller 2*a*. As explained above, the pinch roller 2*b* is disposed in a state where the roller 2*b* is brought into a press-contact with the feed roller 2*a*.

A press-contact force of the pinch roller 2*b* is given by a pinch roller spring 7 as a torsion plate spring disposed therein. One end of the pinch roller spring 7 presses against the pinch roller guide 6 rotatably supporting the pinch roller 2*b*, while the other end thereof is secured to a pinch roller release shaft 11. Then, the pinch roller release shaft 11 is rotated by manipulating an unillustrated release lever, thereby making it possible to adjust the press-contact force acting on the pinch roller 2*b*.

The following is a specific way of adjusting the press-contact force on the pinch roller 2*b*. The whole press-contact force is applied in a case (not shown) where cut sheet is used as the recording medium 1. Further, in a case where the consecutive sheet 1' like a fanfold sheet is used as the recording medium 1 in a state as shown in FIG. 2, if a paper jam happens, the press-contact force is adjusted by rotating the pinch roller release shaft 11 to apply a slight press-contact force. Thus, when the pinch roller 2*b* press-contacting the feed roller 2*a* is released on the occasion of dealing with the paper jam, a structure for releasing only the press-contact force is taken, and a physical separation of the pinch roller 2*b* from the feed roller 2*a* is prevented. This is because an interval between an ink discharging surface 4*a* of the recording head 4 and the recording medium 1 is reduced. With this arrangement, there is prevented a damage to the ink discharging surface of the recording head 4 due to a mistaken drive of the carriage 3 when released.

(Support Member)

The recording medium 1 to which the feeding force is given by the feed roller 2*a* is guided by a platen 10 serving as a support member for supporting a rear surface of the recording medium 1 in the recording position of the recording head 4 and on a more downstream side in the feeding direction of the recording medium 1 than the above recording position and thus brought into a recordable status.

The platen 10 uses a material which gradually discharges electric charges thereof to some other places so that the ink discharged out of the recording head 4 does not undergo an image disturbance due to the static electricity through the recording medium 1, and no electric charge is accumulated on a support surface (feeding surface).

(Recording Unit)

The recording head 4 defined as a recording unit records an ink image on the recording medium 1 fed by the feeding unit 2. The recording unit in this apparatus adopts an ink jet recording method of recording by discharging the ink out of the recording head 4. The recording head 4 includes liquid discharging fine ports (orifices), a liquid path, an energy operating portion provided in part of the liquid path and an energy generating element for generating a droplet forming energy acting on the liquid existing in the energy operating portion.

The energy generating element for generating such an energy entails a recording method involving the use of an electromechanical transducing element such as a piezoelectric element or the like, a recording method using the energy generating element for discharging out the droplets by exothermic action generated when emitting a heat with an irradiation of electromagnetic waves of a laser or the like, or a recording method using the energy generating unit for discharging out a liquid by heating the liquid with an electro-thermal transducing element such as an exothermic element including an exothermic resistor.

The recording head applied to the ink jet recording method of discharging out the liquid with the thermal energy among these methods is allowed to array the liquid discharging orifices for shaping the jet droplets by discharging the droplets for recording with a high density and is therefore capable of performing the record with a high resolution. The recording head involving the use of the electro-thermal transducing element as an energy generating element among them is advantageous in terms of such points that a compact configuration is easy to attain, merits of the IC technology and the microprocessing technology exhibiting a technological advancement and an improvement of reliability that have been remarkable in the recent semiconductor field can be fully utilized, high-density packaging is also easy to attain, and the manufacturing costs are low.

(Carriage)

The recording head 4 is detachably mounted on the carriage 3. The carriage 3 is slidably attached to two guide members 18, 19 provided in a direction orthogonal to the feeding direction of the recording medium 1. An unillustrated motor pulley and an unillustrated tension pulley are attached in the vicinities of both edges of the above guide members in the longitudinal direction thereof. An unillustrated timing belt secured to the carriage 3 is extended between the two pulleys. Accordingly, the carriage 3 mounted with the recording head 4 is moved in reciprocation along the guide members 18, 19 by driving the unillustrated driving source linked to the motor pulley to make forward/reverse rotations thereof.

(Delivering Unit)

The delivering unit 5 feeds and delivers the recording medium 1 on which the record has been effected. The delivering unit 5 includes a delivering roller 5*a* serving as a drive rotary body for imparting the feeding force to the recording medium 1 that is disposed on the side of the rear surface of the recording medium 1. The delivering unit 5 also includes a spur disposed in a face-to-face position with the delivering roller 5*a* with the recording medium 1 interposed therebetween.

The delivering roller 5*a* has a rubber member 5*a*1 partly wound with a rubber material as shown in FIG. 1, and the spur 5*b* is disposed in a face-to-face position with this rubber member 5*a*1.

With the construction described above, even when the recording medium 1 is the consecutive sheet 1', the concave/convex portion of the score line area can be leveled off by reversely bending the sheet once again. The interval between the recording medium 1 and the ink discharging surface of the recording head 4 can be reduced correspondingly, and a recording quality is enhanced.

(Second Embodiment)

In the embodiment discussed above, the countermeasure against the concave/convex portion of the score line area of the consecutive sheet 1' involves providing the shaft 9*a* conceived as a separate member but as the first guide member before to entering into the tractor 8. The present invention is not, however, confined to the construction, and the same effect can be also obtained by forming ribs on the sheet-feeding surface.

Figure 4:
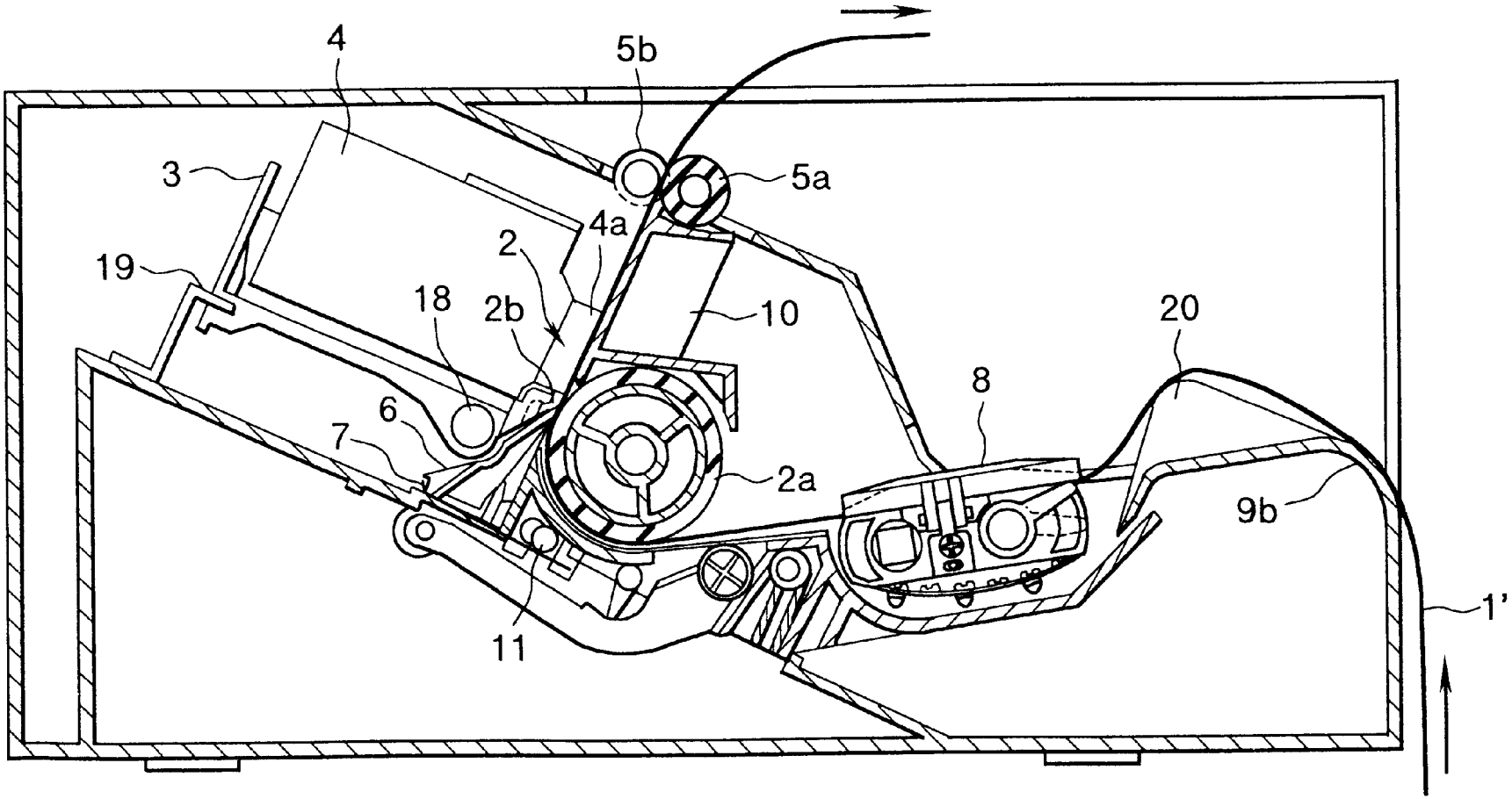
FIG. 4 is a sectional view illustrating the ink jet recording apparatus in a second embodiment of the present invention.

FIG. 4 illustrates a second embodiment relative to the above-mentioned construction. Note that the same reference numerals as those in the first embodiment designate like elements, and the explanations thereof will be omitted. Referring to FIG. 4, a rib-shaped member 20 provided on the sheet-feeding surface exhibits such an effect as to bend the sheet to the reversal side as shown in FIGS. 3A to 3D at a portion from which the consecutive sheet 1' serving as the recording medium 1 enters as in the same way with the shaft 9*a* defined as the first guide member in the above-discussed first embodiment, with the result that the concave/convex portion of the score line area approximates a plane.

(Third Embodiment)

Figure 5:
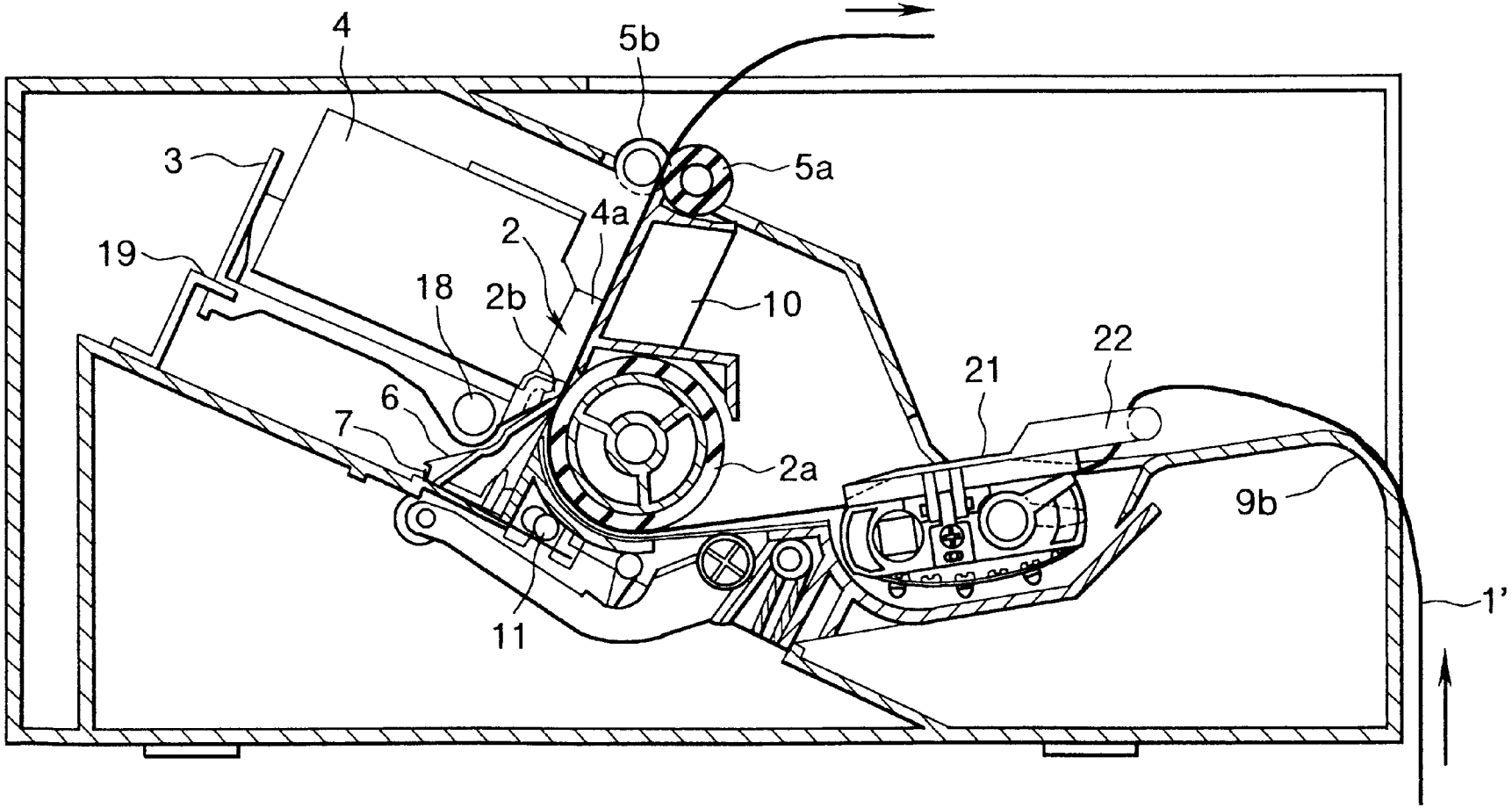
FIG. 5 is a sectional view showing the ink jet recording apparatus in a third embodiment of the present invention.

It is also possible to obtain the same effect by providing a sheet guide member on the tractor itself as a countermeasure against the concave/convex portion of the score line area of the consecutive sheet 1' in accordance with a third embodiment. FIG. 5 illustrates the third embodiment. Note that the same members as those in the first embodiment are designated with like numerals, and the explanations thereof will be omitted. Referring to FIG. 5, a sheet guide 22 provided on a tractor 21 exhibits the effect to bend the sheet to the reversal side as shown in FIGS. 3A to 3D at the portion from which the consecutive sheet 1' defined as the recording medium 1 enters as in the same way with the shaft 9*a* serving as the first guide member in the above-discussed first embodiment, whereby the concave/convex portion of the score line area approximates the plane.

(Fourth Embodiment)

The first through third embodiments have dealt with the countermeasure against the concave/convex portion of the score line area in the case of feeding the consecutive sheet 1' according to the push-type tractor placement. In a fourth embodiment, however, a pull-type tractor placement will be described with reference to FIG. 6. Note that the same members as those in the first embodiment designate the like numerals, and the explanations thereof will be omitted.

Figure 6:
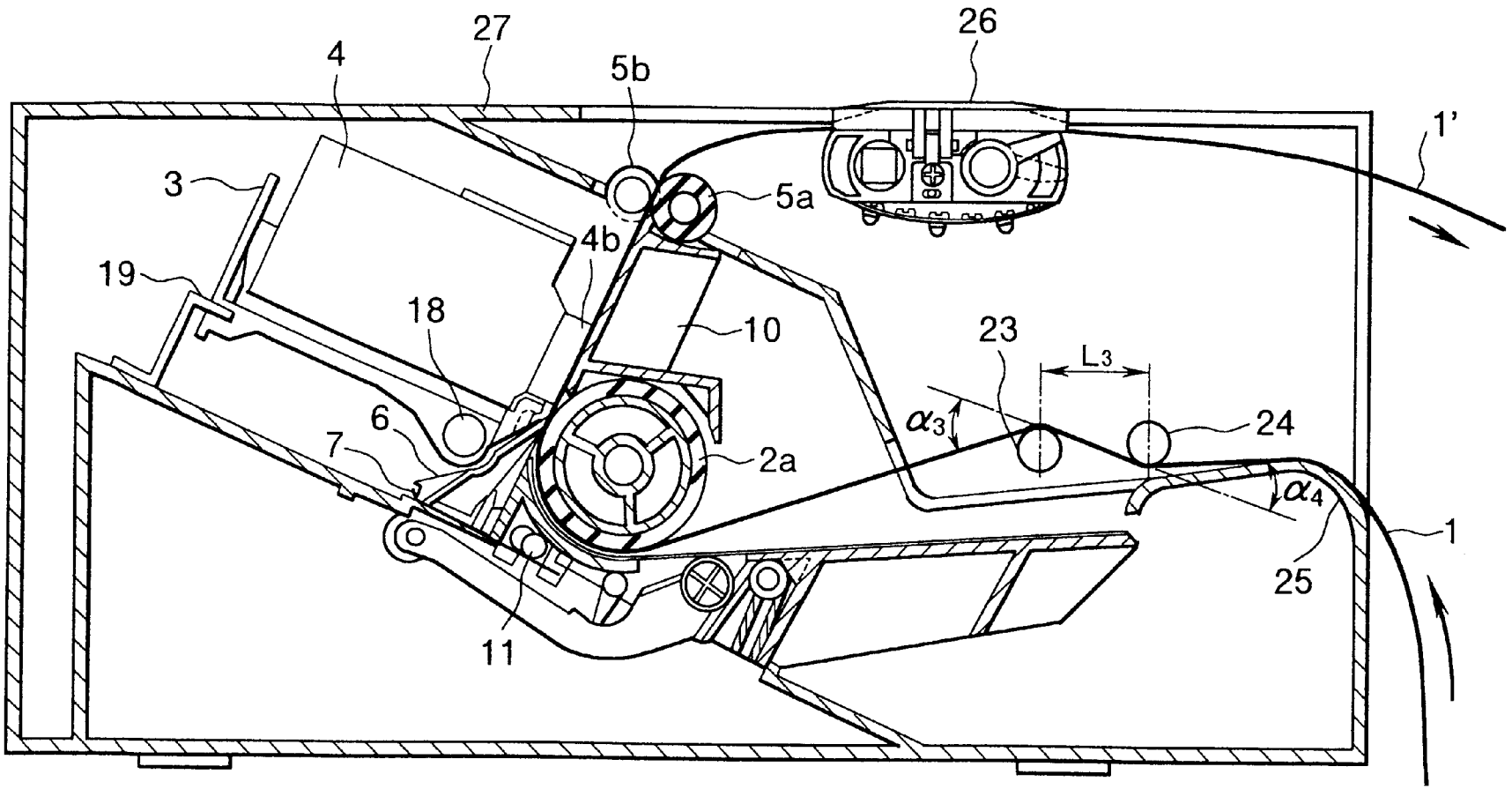
FIG. 6 is a sectional view illustrating the ink jet recording apparatus in a fourth embodiment of the present invention.
Figure 7:
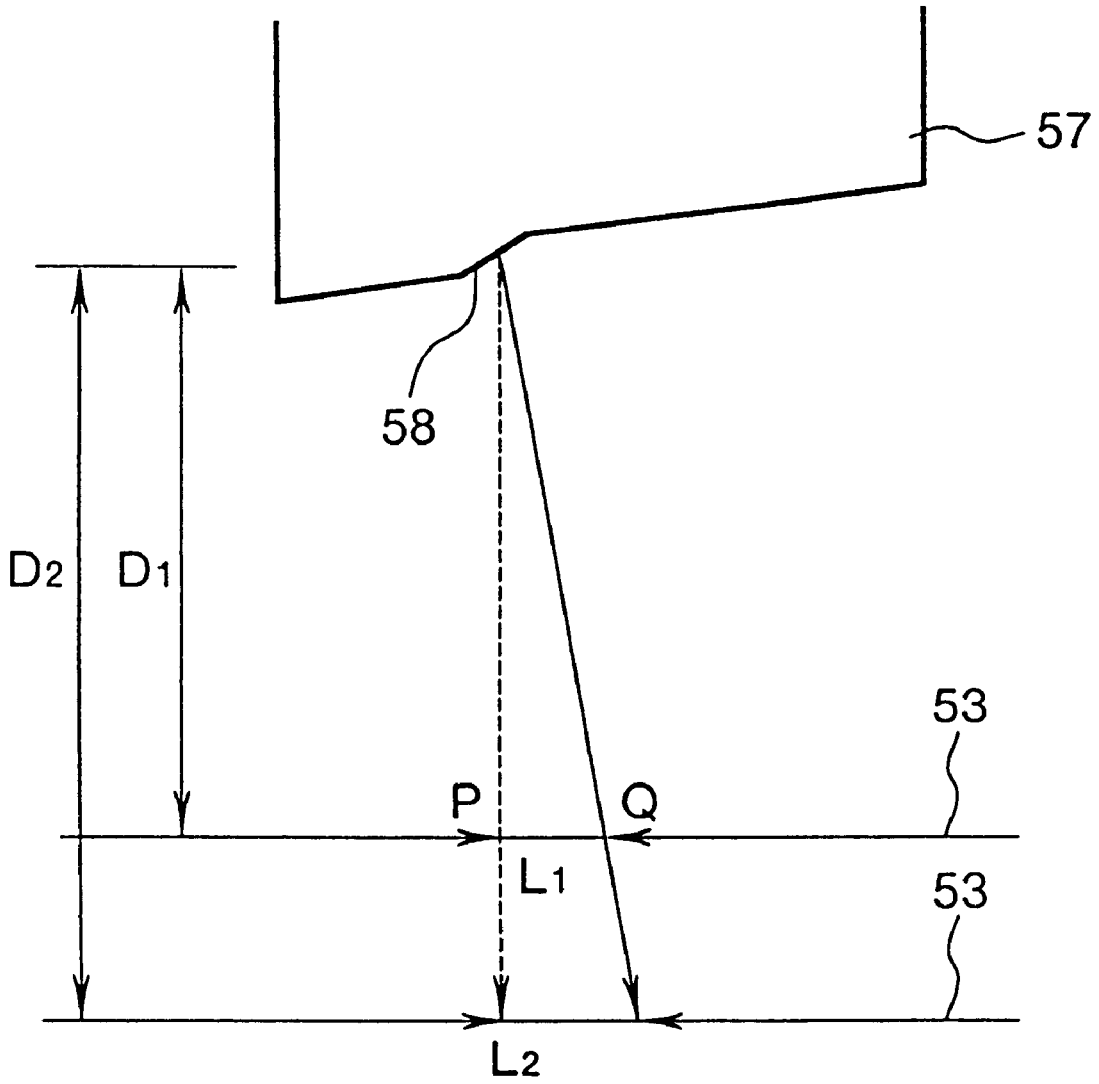
FIG. 7 PRIOR ART
FIG. 7 is an explanatory diagram showing a case where ink discharging directions from nozzles are not the same in a conventional ink jet recording apparatus.
Figure 8:
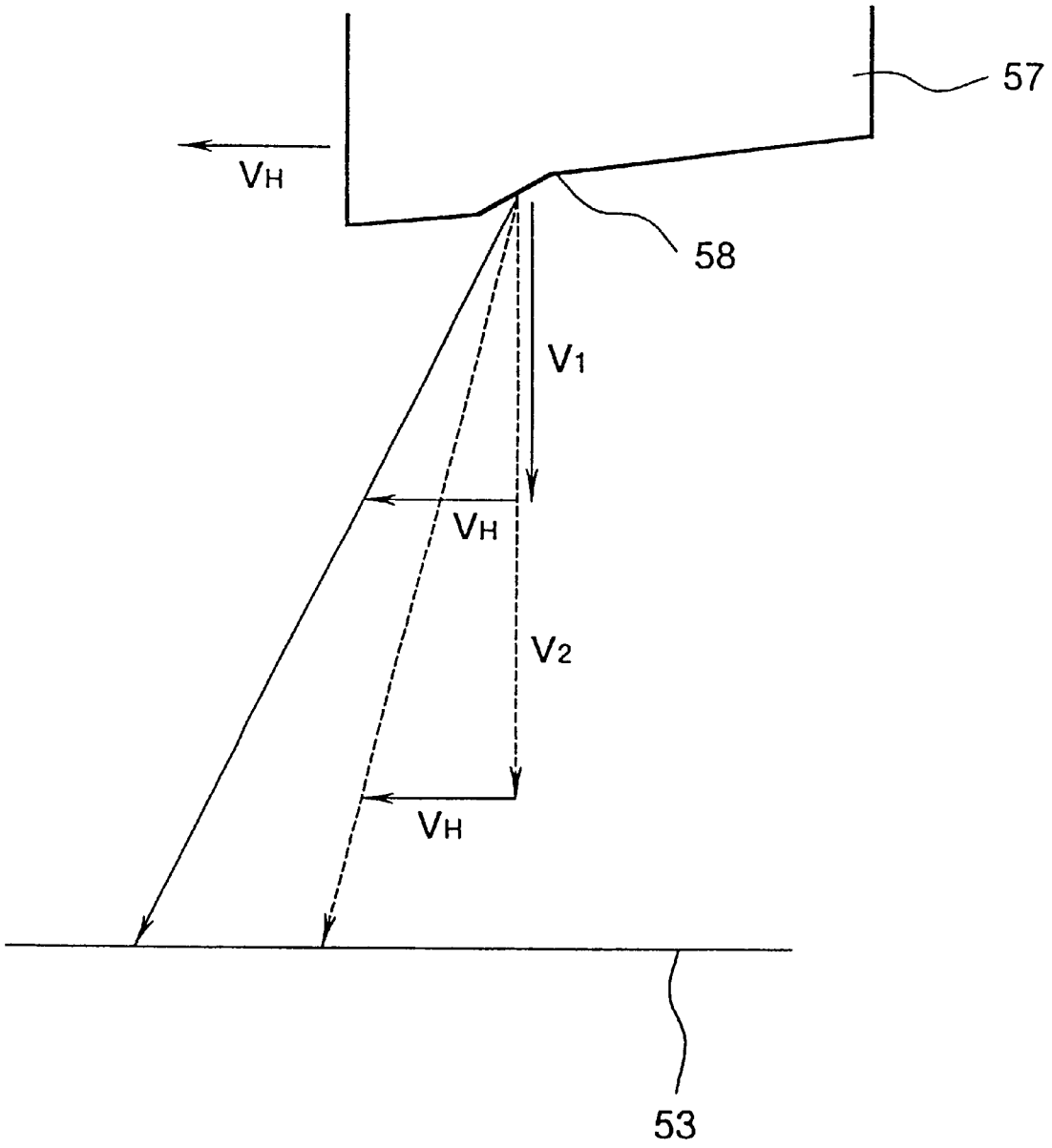
FIG. 8 PRIOR ART
FIG. 8 is an explanatory diagram showing a case where ink discharging speeds from the nozzles are different in the conventional ink jet recording apparatus.
Figure 9:
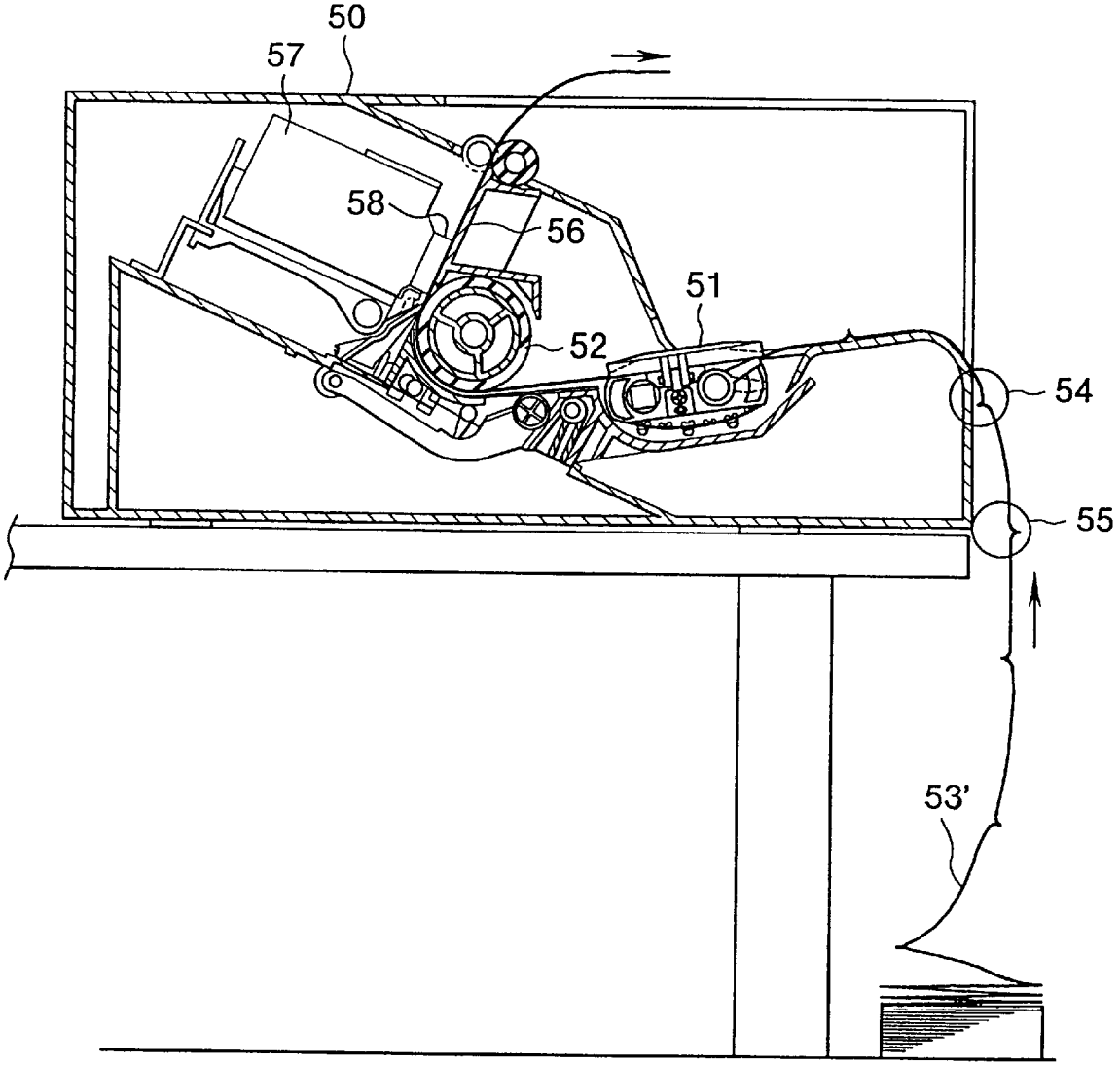
FIG. 9 PRIOR ART
FIG. 9 is an explanatory view showing an influence of a score line of a consecutive sheet.

Referring to FIG. 6, as in the first embodiment, the consecutive sheet 1' defined as the recording medium 1 is bent to the reversal side by a third guide member 25 provided on part of a recording device 27 as well as by first and second shaft-shaped guide members 23, 24 provided more upstream in the feeding direction than the recording position, with the result that the concave/convex portion of the score line area approximates the plane.

At this time, a distance $L_3$ between the first guide member 23 and the second guide member 24 is 25 mm, an angle $\alpha_3$ form by sheet surface is 35°, a distance between the second guide member 24 and the third guide member 25 is 25 mm, and an angle $\alpha_4$ formed by the sheet surface is 35°.

The consecutive sheet 1' (as recording medium 1) approximating the plane owing to the above placement is delivered by the tractor 26 disposed more downstream in the feeding direction than the discharging unit 5 after being recorded at the recording position.

Note that the tractor may be, as a mater of course, provided either upstream or downstream from the recording position.

As discussed above, according to the present invention, the correcting mechanism for correcting the concave/convex portion of the recording medium is provided upstream in the feeding direction from the recording unit. With this provision, the configuration of the recording medium approximates the plane, and the interval between the recording medium and the recording unit can be reduced correspondingly. An error in recording by the recording unit is consequently decreased, and the image quality is enhanced.

The correcting mechanism includes the first guide member capable of bending the sheet toward one of the front and rear surface of the recording medium on the basis of the widthwise direction of the recording medium and the second guide member capable of bending the sheet to the other side. With a simple construction, the concave/convex portions of both of the front and rear surfaces of the recording medium can be corrected.

The guide members are provided entirely in the widthwise direction of the recording medium, whereby the bending force acts entirely in the widthwise direction of the recording medium, and the correcting capability is enhanced.

The tractor for regulating both edges of the recording medium is provided upstream in the feeding direction from the recording unit, and this tractor and the first guide member are formed into one united body. This leads to a reduction in the number of parts and a decrease in costs.

It is apparent that, in this invention, a wide range of different working modes can be formed based on the invention without deviating from the spirit and scope of the invention. This invention is not restricted by its specific working modes except being limited by the appended claims.

What is claimed is:

1. An ink jet recording apparatus comprising:

a feed roller for feeding a consecutive sheet;

a tractor for feeding the consecutive sheet;

a recording head for recording an image on the consecutive sheet fed by said feed roller; and correcting means, provided in a feeding direction upstream of said recording head, for correcting a concave/convex portion of the consecutive sheet formed in a thickness direction of the consecutive sheet over the entire width of the consecutive sheet, said correcting means comprising a guide member for bending the consecutive sheet toward one of a front surface and a rear surface of the consecutive sheet about a widthwise direction of the consecutive sheet and a portion from which the consecutive sheet enters said tractor, said portion being provided on said tractor, wherein said portion of said tractor cooperates with said guide member to bend the consecutive sheet fed from said guide member to the other one of the front surface and the rear surface.

2. A recording apparatus comprising:

a feed roller for feeding a recording medium;

recording means for recording an image on the recording medium fed by said feed roller;

a tractor for feeding the recording medium; and correcting means, provided in a feeding direction upstream of said recording means, for correcting a concave/convex portion of the recording medium formed in a thickness direction of the recording medium over the entire width of the recording medium, said correcting means comprising a guide member for bending the recording medium toward one of a front surface and a rear surface of the recording medium about a widthwise direction of the recording medium and a portion from which the recording medium enters said tractor, said portion being provided on said tractor, wherein said portion of said tractor cooperates with said guide member to bend the recording medium to the other one of the front surface and the rear surface.

3. A recording apparatus according to claim 2, wherein said guide member is provided entirely in the widthwise direction of the recording medium.

4. A recording apparatus according to claim 1, wherein said tractor is provided in the feeding direction upstream of said recording means and said tractor and said guide member are formed into one united body.

5. A recording apparatus according to claim 3, wherein said tractor is provided in the feeding direction upstream of said recording means and said tractor and said guide member are formed into one united body.

* * * * *

UNITED STATES PATENT AND TRADEMARK OFFICE

CERTIFICATE OF CORRECTION

PATENT NO. : 6,033,067
APPLICATION NO. : 08/946572
DATED : March 7, 2000
INVENTOR(S) : Kakizaki et al.

It is certified that error appears in the above-identified patent and that said Letters Patent is hereby corrected as shown below:

COLUMN 4:
Line 31, “becomes more” should read --comes--.

COLUMN 8:
Line 56, “claim 1,” should read --claim 2,--.

Signed and Sealed this

Seventeenth Day of July, 2007

JON W. DUDAS
*Director of the United States Patent and Trademark Office*